US006968665B2

(12) United States Patent
Lawson

(10) Patent No.: US 6,968,665 B2
(45) Date of Patent: Nov. 29, 2005

(54) POOL GRATING AND A METHOD OF INSTALLATION

(76) Inventor: Robert B. Lawson, 3330 Lakeview Dr., Naples, FL (US) 34112

( * ) Notice: Subject to any disclaimer, the term of this patent is extended or adjusted under 35 U.S.C. 154(b) by 0 days.

(21) Appl. No.: 10/609,226

(22) Filed: Jun. 30, 2003

(65) Prior Publication Data

US 2004/0003549 A1 Jan. 8, 2004

Related U.S. Application Data

(63) Continuation of application No. 09/867,243, filed on May 30, 2001, now abandoned.

(51) Int. Cl.[7] ..... B23P 19/04; B23P 19/10

(52) U.S. Cl. ..... 52/745.2; 52/745.05; 52/745.06; 52/180; 52/177; 52/660; 29/897.15; 29/433; 29/464; 210/164; 210/169

(58) Field of Search ..... 52/181, 177, 180, 52/745.06, 745.05, 660, 666, 667, 676, 169.7, 52/745.2; 210/163, 164, 169

(56) References Cited

U.S. PATENT DOCUMENTS

| | | | | | |
|---|---|---|---|---|---|
| 846,291 | A | * | 3/1907 | Emerson | 52/663 |
| 1,561,120 | A | * | 11/1925 | Smith | 210/164 |
| 1,694,633 | A | * | 12/1928 | Wells | 29/34 R |
| 2,305,955 | A | * | 12/1942 | Dudley | 210/164 |
| 3,381,355 | A | * | 5/1968 | Bixby | 29/897.15 |
| 3,471,022 | A | * | 10/1969 | Conrad | 210/169 |
| 3,660,956 | A | * | 5/1972 | Budlong | 52/669 |
| 3,742,671 | A | * | 7/1973 | Ellis | 52/507 |
| 3,824,634 | A | * | 7/1974 | Lindqvist | 4/510 |
| 3,864,887 | A | * | 2/1975 | Arens | 52/664 |
| 3,918,107 | A | * | 11/1975 | Whitten et al. | 4/496 |
| 3,990,167 | A | * | 11/1976 | Whitten, Jr. | 40/618 |
| 4,007,566 | A | * | 2/1977 | Molitor | 52/169.7 |
| 4,037,383 | A | * | 7/1977 | Diebold et al. | 52/664 |
| 4,126,404 | A | * | 11/1978 | Ferns | 404/4 |
| 4,137,003 | A | * | 1/1979 | Budoff | 408/103 |
| 4,244,768 | A | * | 1/1981 | Wiechowski et al. | 156/293 |
| 4,522,009 | A | * | 6/1985 | Fingerson | 52/667 |
| 4,601,618 | A | * | 7/1986 | McEldowney | 408/1 R |
| 4,727,704 | A | * | 3/1988 | Carlton | 52/667 |
| 4,758,292 | A | * | 7/1988 | Baker | 156/71 |
| 4,897,299 | A | * | 1/1990 | Kawachi et al. | 428/131 |
| 4,952,094 | A | * | 8/1990 | Spiess et al. | 405/36 |
| 4,952,101 | A | * | 8/1990 | Coombs | 408/115 R |
| 4,968,170 | A | * | 11/1990 | Wilson et al. | 404/2 |
| 4,991,294 | A | * | 2/1991 | Breiner et al. | 29/897.34 |
| 5,036,639 | A | * | 8/1991 | Micko | 52/507 |
| 5,291,714 | A | * | 3/1994 | Wright et al. | 52/664 |
| 5,650,066 | A | * | 7/1997 | Blandin et al. | 210/169 |
| 6,422,795 | B2 | * | 7/2002 | Holt et al. | 410/115 |

FOREIGN PATENT DOCUMENTS

| | | | | |
|---|---|---|---|---|
| CH | 2656902 | * | 3/1978 | 52/181 |

(Continued)

*Primary Examiner*—Phi Dieu Tran A

(57) ABSTRACT

A grate for a swimming pool structure is constructed by placing a multiple of grate bars in an elevated position above the gutter which is parallel to the pools edge including any curvatures. The grate bars follow the curvatures of the pool's edge. When in the elevated position, the multiple of parallel grate bars are clamped together and a hole is drilled through all of the parallel grate bars. A retaining bolt is placed through all of the grate bars including the curvatures of the pools'edge and the bolts are fastened therein. There after, the assembled unit of grate bars is lowered into the gutter to be even with the surface of the deck and the water surface.

5 Claims, 6 Drawing Sheets

FOREIGN PATENT DOCUMENTS

| | | | | |
|---|---|---|---|---|
| EP | 506499 | * | 9/1992 | ..... 52/581 |
| JP | 336148 | * | 12/1999 | ..... 404/2 |

* cited by examiner

POOL GRATING AND A METHOD OF INSTALLATION

This Application is a Continuation of application Ser. No. 09/867,243 having a filing date of May 30, 2001 now abandoned.

STATEMENT REGARDING FED SPONSORED R & D (none)

REFERENCE TO MICROFICHE APPENDIX (none)

BACKGROUND OF THE INVENTION

The invention pertains to pool constructions, particularly, it is directed to the overflow gutter concept. The overflow gutter concept is increasingly being used in the United States and other countries. This concept is not only used in large swim competition pools but also for leisure and residential pools. The perimeter overflow system is often called, deck level, overflow or wet deck. This type of construction involves a gutter which is placed around the whole perimeter of the pool and placed at the deck level of the pool so that water can flow into the gutter and a grating covers the opening of the gutter which is placed at deck level. The grate has to be rigid and strong enough to accommodate foot traffic near the edge of the pool.

Known gratings have connecting stays that run perpendicular to a pool wall. They are extruded, are somewhat flexible and can handle a radius. Straight grates, wherein the stays run parallel to the pool wall, are very rigid and cannot undergo a radius when installing the same, or when necessary to curve the same is very difficult to install and expensive and is subject to failure under certain circumstances. Also the grate bars that run perpendicular to the pool wall are pre-formed by heating and then set into a predetermined radius which does not guarantee a perfect fit. One example is the use of industrial fiberglass which is extruded into sheets. Thereafter, the perpendicular stays are manufactured into the fiber glass sheet to obtain parallel spacing and cut to size. These sheets cannot be placed in a radius at all and, therefore, can only be used in square or rectangular pools. There is a problem with gratings having stays that run perpendicular to the pool wall in that the wave action created by the occupants in the pool will cause the water to splash over the grate and onto the deck. This is so, because the parallel stays will tend to funnel the water through the spaces between them. However, Gratings constructed with stays or grate bars that are parallel to the edge of the,pool have a tendency to hinder the flow of water over the grate because the parallel stays present an obstacle to water flow. Gratings are normally about twelve inches wide and observations have shown that in this type of grate, the water travels at most over no more than 3 gaps. This way the water disappears quickly into the gutter below the grating resulting in a much dryer deck resulting in less falls when bare feet walk over the deck.

BRIEF SUMMARY AND OBJECTS OF THE INVENTION

One object of the invention is to simplify the construction of pool gratings and to simplify the installation of pool gratings while improving the accuracy of the installation. Another object is to improve the water flow over the grate while the deck surrounding the pool remains much dryer while improving the safety aspect of the users of the pool. The above noted objects are achieved by injection molding the grate bars wherein the bars are running parallel to the wall of the pool to thereby create open spaces to avoid splash over the gutter. The injection molded grate bar can fit any free form radii down to six feet. They are interlocking grates which is not known in the art. A jig system is used for the installation to form the grate bars to fit the radii of the gutter unlike other gratings where the gutter is made to conform to the pre-made and set radius of the grating.

DETAILED DESCRIPTION OF THE PREFERRED EMBODIMENTS

Figure 1:
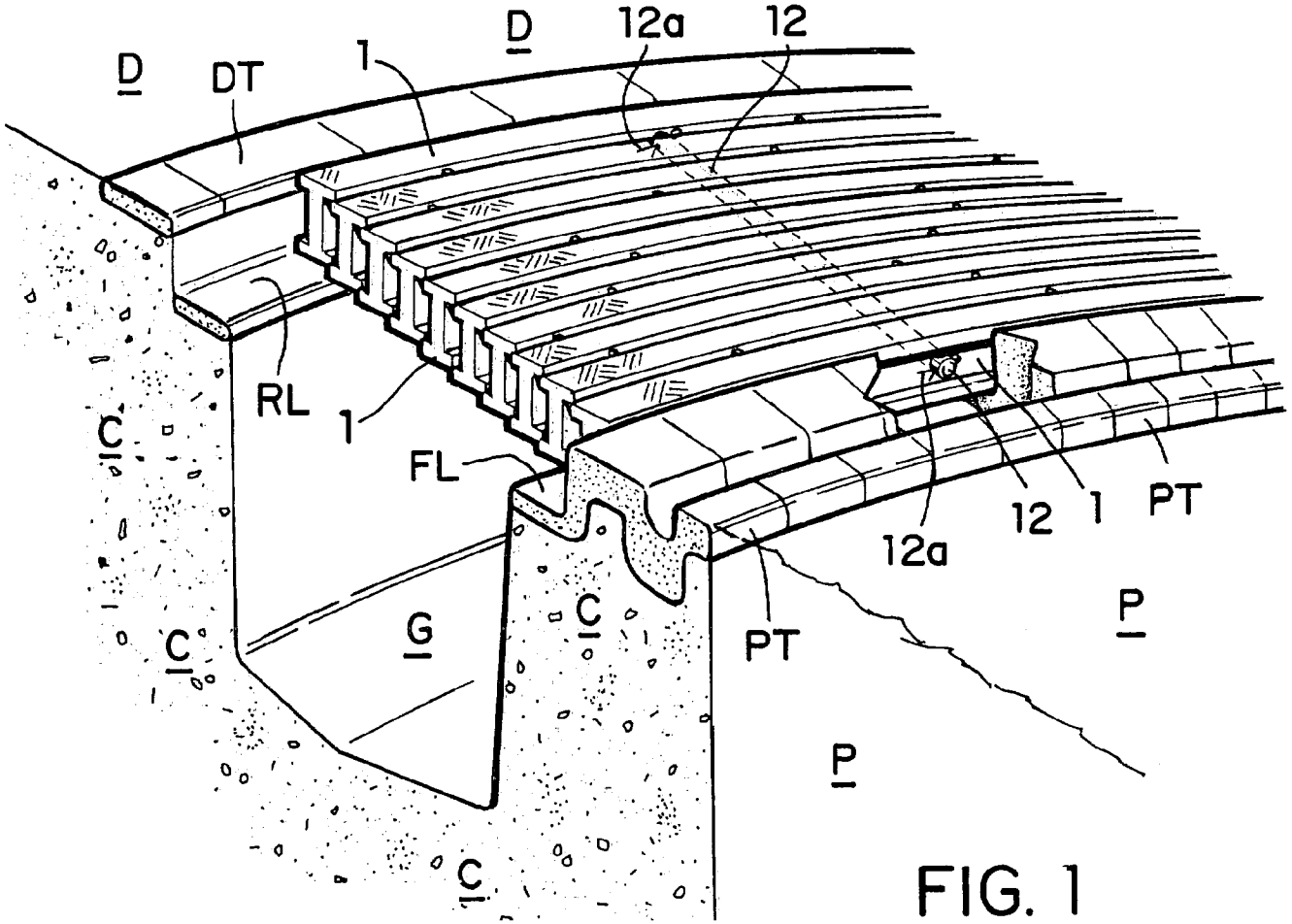
FIG. 1 is a top view of a short straight and a short curved section.

Turning now to FIG. 1, there is shown the grating as it is installed in the gutter G which is installed close to the perimeter of the pool P itself, as is well known. As can be seen from this top view, the grating bars 1 are placed parallel to the edge of the pool P and, of course, follow the radius of any curvatures that have been designed into the layout of the pool.

Figure 2:
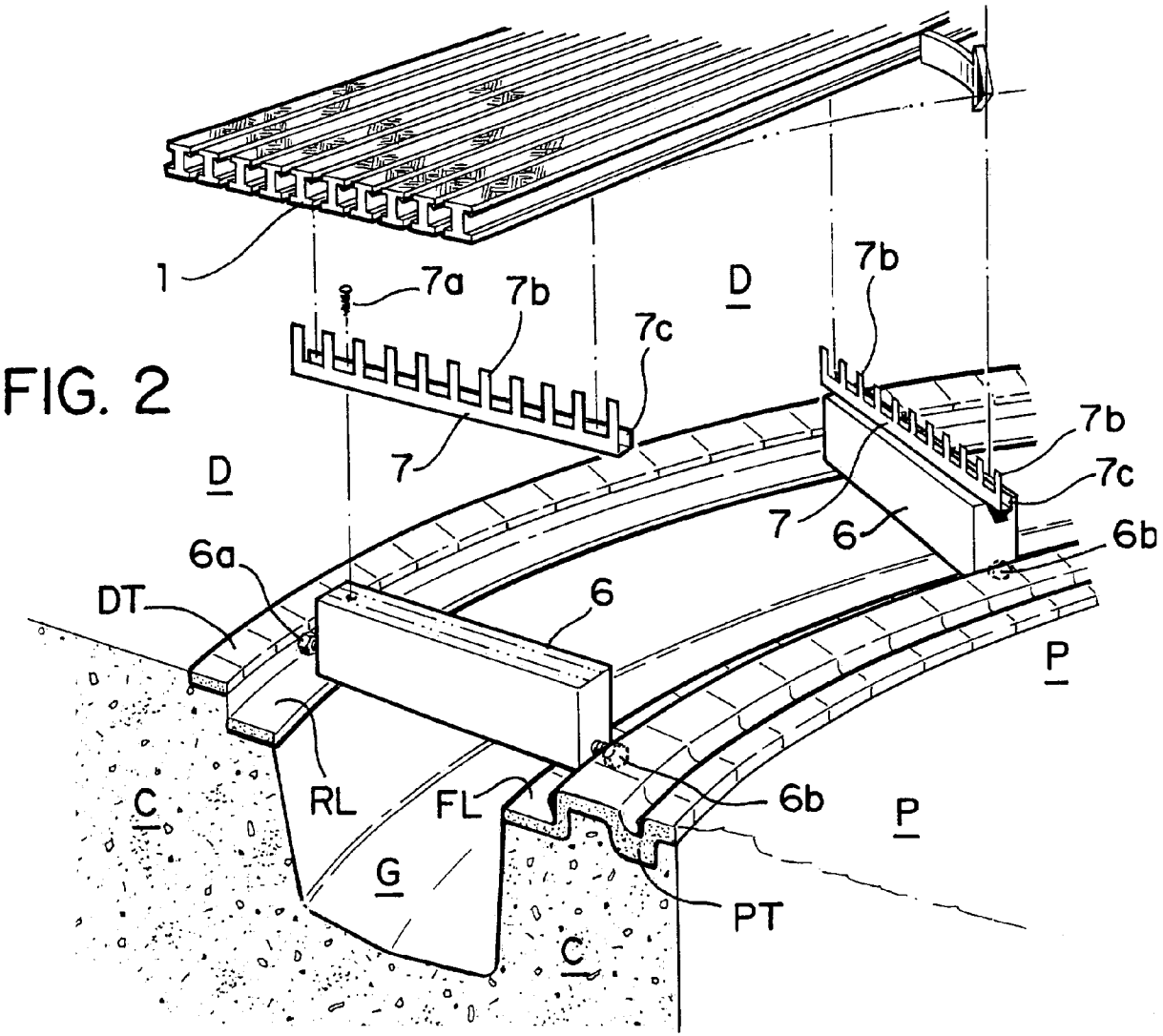
FIG. 2 is an exploded view of the grating prior to an installation.

In FIG. 2 the gutter is shown as G which is designed or placed in the concrete C. At the same time, after the concrete has been poured or at some time thereafter, the pool tiles are being installed. Thus, there is a multiple of adjacent pool tiles PT having a forward ledge FL and there is a multiple of adjacent deck tiles DT having a rear ledge RL. Both the forward ledge FL and the rear ledge RL are in the same horizontal plane and will form the support for the grating once it is installed. When installing the grating, a multiple of wooden blocks 6 are placed on the tile ledges FL and RL at predetermined distances spaced apart including the curves of the pool. The wooden blocks 6 form a jig support and are centered in the gutter by adjustment screw heads 6*a* and 6*b* which abut the walls of the tile and at the same time fasten the blocks in place. Once installed in the gutter, the wooden blocks 6 each receive an adjustment jig 7 on its top side which jigs 7 are fastened to the wooden block by way of screws 7*a*.

Each adjustment jig is made of a rustproof material such as galvanized steel, for example. Also the adjustment jig 7 is formed in a J shape to thereby form an upstanding edge 7*c* and in the upper long leg of the J shape a multiple of upstanding tines 7*b* are provided. The distance between the tines 7*b* corresponds to the width of the grate bars 1. Once the wooden blocks with the adjustment jigs fastened on each of their tops are installed in the gutters, the grate bars 1 are now assembled in a unit of a size in width to correspond exactly to the width of the gutter. The reason why the grate bars 1 must first be assembled in a unitary unit is because the grate bars have spacing webs (FIG. 3) between themselves so that they will maintain a certain space between each other.

Figure 3:
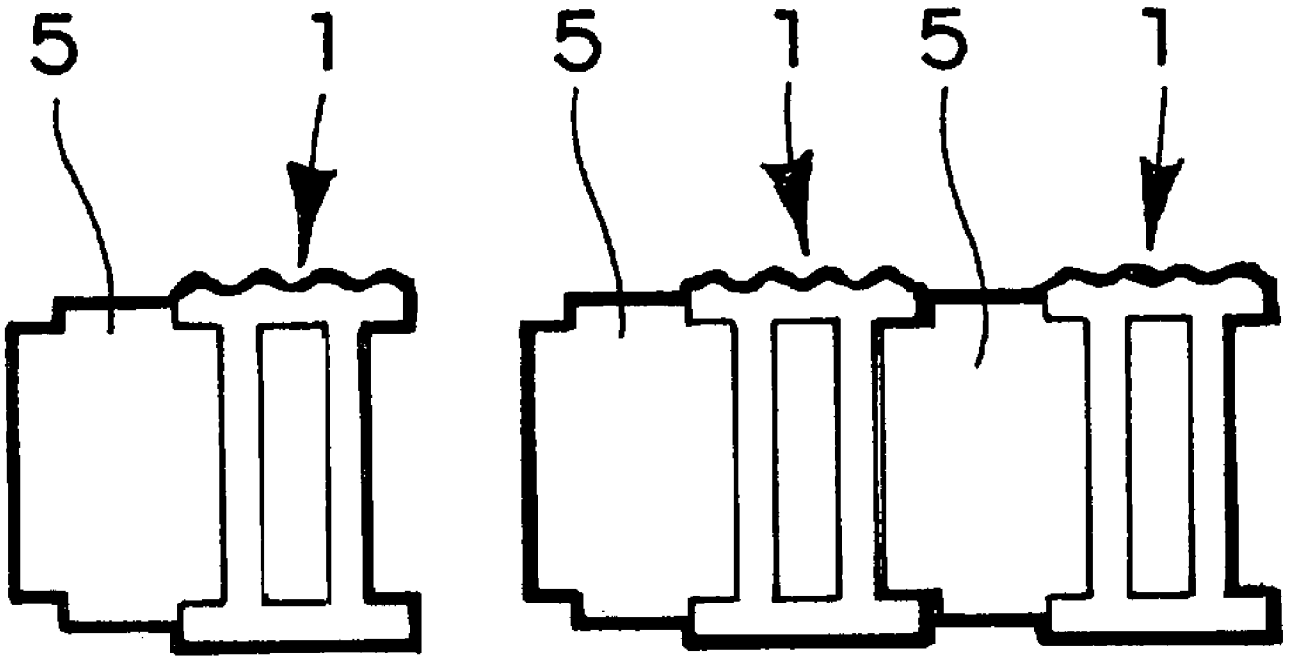
FIG. 3 illustrates a spacer web between grate bars.

As can be seen from FIG. 3, the grate bars 1 have an I shape and the spacing webs 5 in FIG. 3 are so designed to have a clamping fit between adjacent I shapes. The spacing webs are formed integrally with the grate bars when the grate bars are molded.

Figure 4:
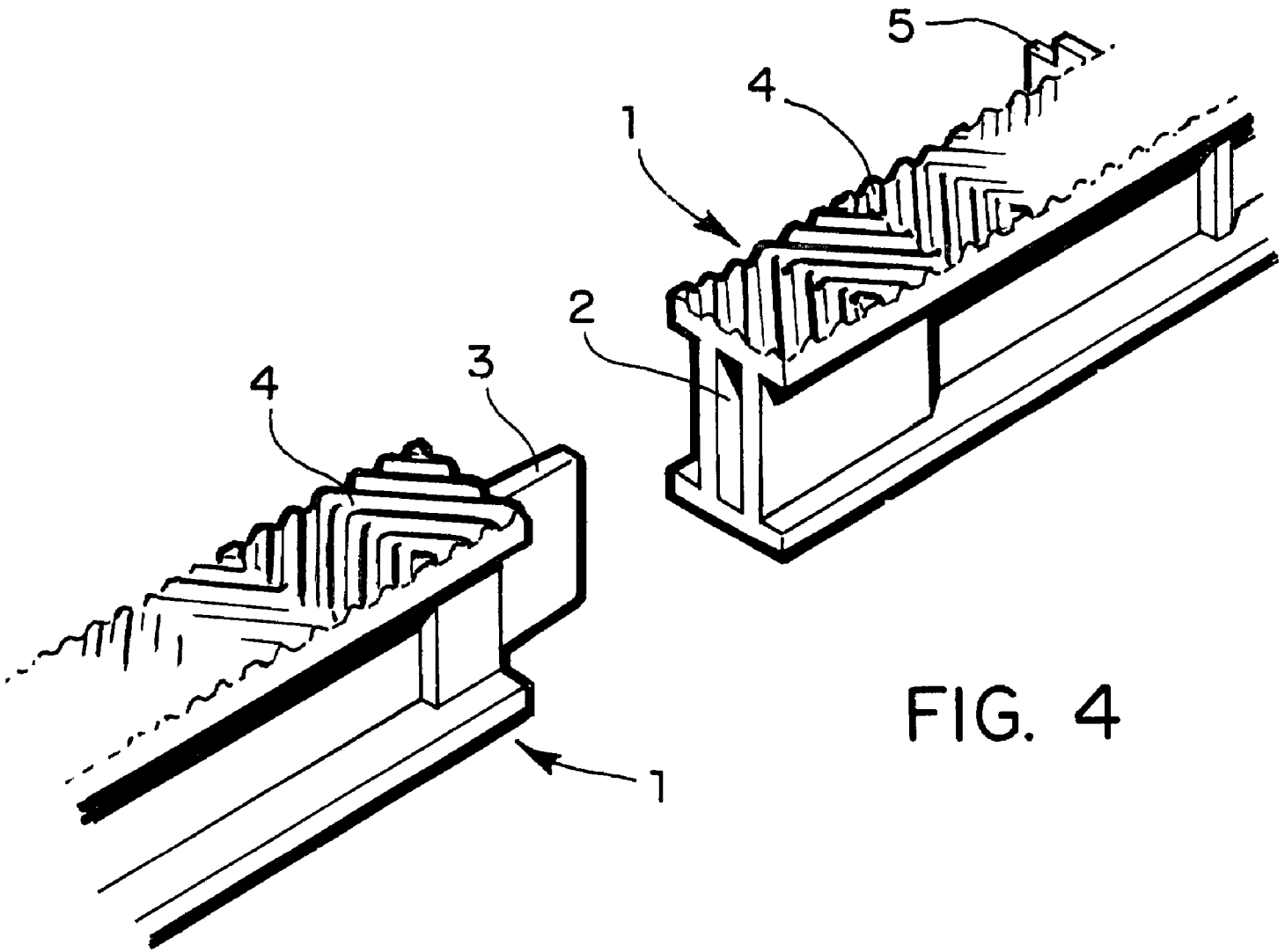
FIG. 4 illustrates how grate bars are connected together.

Turning now to FIG. 4, there is shown how two separate grate bars are connected to each other in a longitudinal direction. Again, during the molding process, a male tongue is formed on one end of the grate bar while on the other end a female recess 2 is provided. The tongue 3 and the recess 2 of the next bar will snap-fit into each other to make a secure connection and to form continuous grate bars when the installation commences. Also shown in FIG. 4 are the tread imprints as embedded ribs 4 which altogether form a slip-proof surface.

Returning now to FIG. 2 and as mentioned above, the grate bars 1 are assembled into one unit and are then lowered until each of the grate bars will fit between the tines 7*b* of the alignment jig 7 until all of them rest on the upstanding edge 7*c* of the adjustment jig 7. This is easily accomplished in the straight section of the pool. However, when encountering the curves or the radii of the pool, all of the grate bars in the unitary section of the pre-assembled grating will have to be bent to conform to any particular curve of the gutter of the pool so that they can be settled between the tines 7*b* of the adjustment jig 7 which had already been placed in the curve and into the gutter of the pool. While bending the grate bars into a curve, the individual bars 1 will remain spaced from each other at a predetermined space because of the presence of the spacer webs 5 between them. Also, the individual grate bars are in a continuous line because they are all longitudinally connected to each other through the tongue 3 and the recess 2, see FIG. 4.

It should be understood that once all of the grate bars are connected to each other and are assembled adjacent to each other into a completed grating in the above noted adjustment jigs, the total grating is still elevated above the gutter G and the Deck D of the pool, but in a proper vertical alignment, and therefore is still accessible from above and below its surfaces. It is now a matter of fastening all of the grate bars to each other before they can be lowered into the proper position in the gutter.

Figure 5:
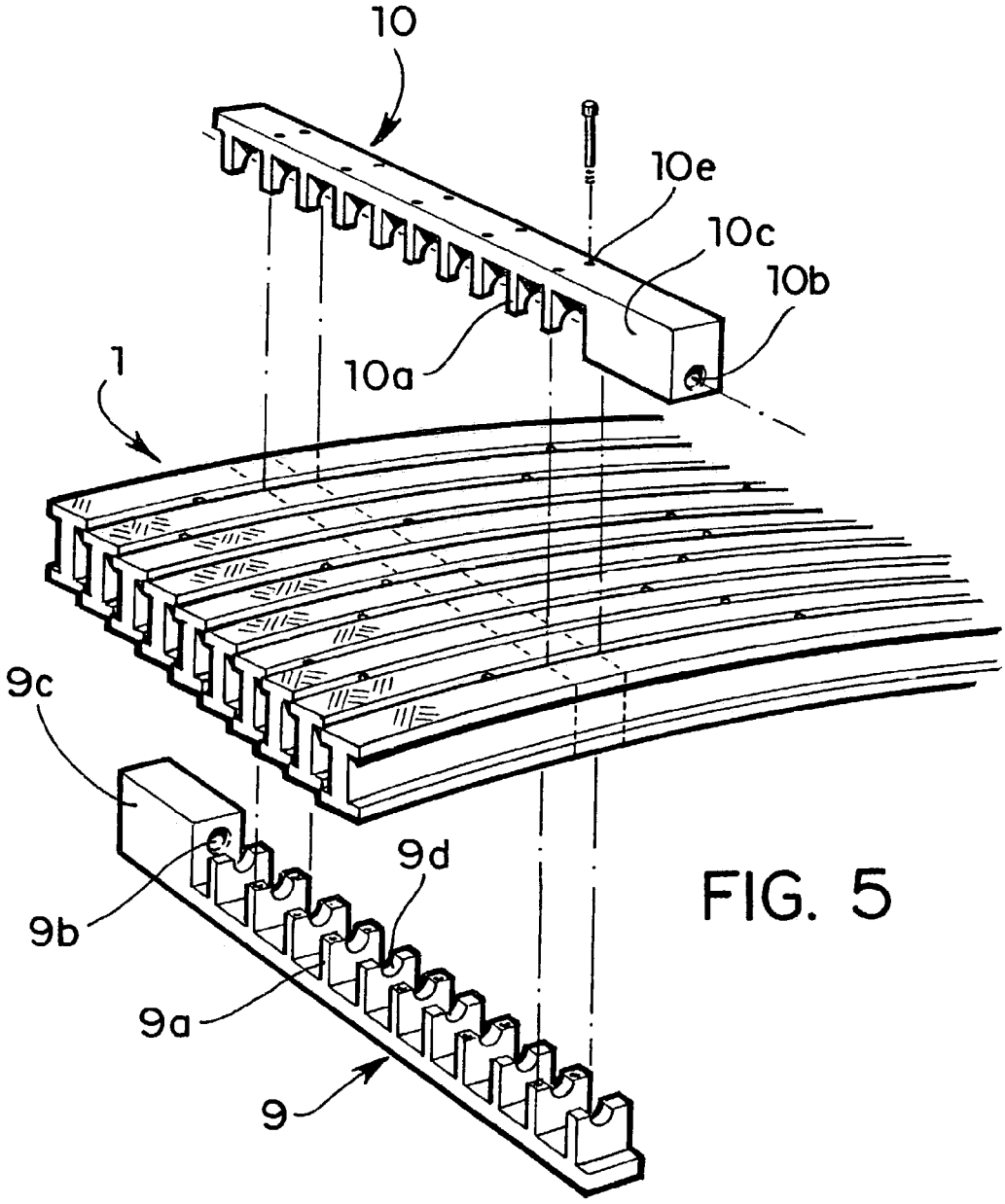
FIG. 5 shows an exploded view of clamp bars prior to assembly.

FIG. 5 shows an exploded view of the clamping bars used to accomplished the above noted task. In this respect, there is a lower clamping bar 9 which has upstanding spacers 9*a* which will fit exactly between the spaces of the individual grate bars 1. Shown toward the rear is a drill block 9*c* that has a pilot drill hole 9*b* there through. Also shown in FIG. 5 is an upper clamping block 10 having depending spacers 10*a* which again will fit exactly between the spaces of the individual grate bars 1. Also, there is shown a forward drill block 10*c* having a pilot drill hole 10*b* there through. Also, the upper clamping block 10 has screw receiving holes 10*e* therein so that the two clamping blocks 9 and 10 can be connected to each other. The same screw holes are present in the lower clamping block 9. As a matter of fact, both clamping blocks 9 and 10 are identical to each other and can be used interchangeably with each other, either up or down.

Figure 6:
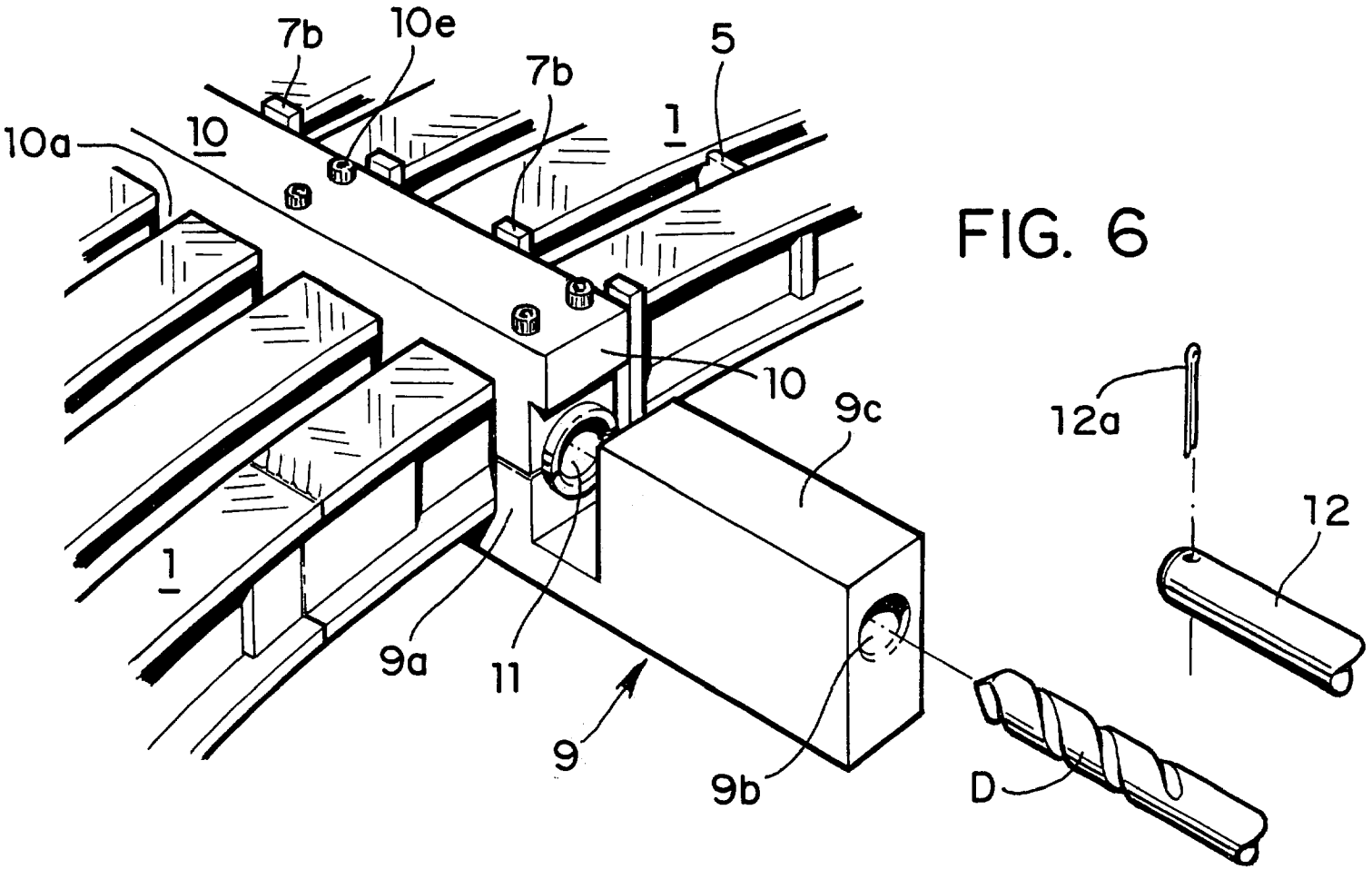
FIG. 6 shows clamp bars after an assembly.

FIG. 6 shows the two clamping bars 9 and 10 assembled with each other. It is noted that the former upper clamping bar of FIG. 5 is now the lower clamping bar because the drill block 10*c* is facing forward as at 9*c*. It is also noted that the depending spacers 10*a* have settled between the individual grate bars 1. The upstanding spacers 9*a* can only be seen at the front of the assembly. The screws 10*e* connect the two clamping bars together into a rigid structure. The half holes 9*d* (only shown in 9 FIG. 5) but also present in 10, now form a complete circle 11 throughout both of the assembled blocks 9 and 10. It should also be noted that the assembled clamping structure is placed adjacent the upstanding tines 7*b* of the adjustment jig 7. This assures an exact alignment of all the necessary elements prior to finishing the Grating.

It is now necessary that a lateral hole be drilled through all of the adjacent grate bars. To this end a drill bit D is passed through the pilot hole 9*b* in drill block 9*c* and then the drill bit D commences to drill holes through all of the grate bars 1. After this is accomplished, the clamping bars 9 and 10 are removed and a predetermined length of a rod 12 is placed through all of the drilled holes and a cotter pin 12*a* or other fastener is placed at each end of the rod to hold all of the assembled grate bars 1 together in a completed grating. Also see FIG. 1.

Following the assembly of the grating, the remaining assembly elements can now be removed, that is the wooden block 6 with the adjustment jig on its top can be removed one at a time and the assembled grating can now be lowered into the gutter so that it will seat simultaneously on the two tile ledges RL and FL. From all of the above, it should also be clear that the completed grating can be lifted to some extent at any time if the need arises. The curvature of the assembled grate bars will not be disturbed because the rods 12 will hold everything together and in place because of the fasteners 12*a*. The rods should be made of a rustproof material such as stainless steel, fiberglass or an appropriate plastic material.

It is also pointed out that all the grate bars are of the same length and therefore, after they are assembled and they are bent around a curve, the connection points of the grate bars will shift relative to each other, while in straight sections, they will remain next to each other. This is a well known phenomenon.

I claim:

1. A method of assembling a grating for a swimming pool, said pool having edges including curvatures, and a gutter spaced from said edge including curvatures corresponding to said edge curvatures constructed in a deck of said pool, Said grating including a multiple of grate bars that are connected to each other in a longitudinal direction, said method comprising the steps of:

assembling a multiple of said grate bars parallel to each other and parallel to said pool edge on said gutter in an elevated position, clamping said assembled grate bars into a unit and thereafter drilling a hole through all of said clamped bars, passing a rod through all of said drilled holes and fixing each end of said rod to prevent a movement of said rod in any direction, Thereafter lowering said assembled grating into said gutter to be substantially flush with said deck of said pool.

2. The method of claim 1, including the step of bending all of said assembled grate bars to correspond to said curvatures in said gutter prior to the step of drilling said holes through said grate bars.

3. The method of claim 1, wherein said step of assembling said grate bars in an elevated position includes the step of placing a support block in said gutter and placing an adjustment jig on a top surface of said support block.

4. The method of claim 1, including passing a multiple of said rods in a multiple of locations along said assembled grate bars including said curvatures.

5. The method of claim 1, including placing clamping bars on top and below said grate bars prior to said step of drilling, clamping said clamping bars together, providing a drilling pilot hole through said clamping bars to assure an exact drilling through said assembled grate bars.

* * * * *